US008844083B2

(12) United States Patent
McGivern et al.

(10) Patent No.: US 8,844,083 B2
(45) Date of Patent: Sep. 30, 2014

(54) ADJUSTABLE, MODULAR HANDICAP-ACCESS-RAMP SYSTEM

(75) Inventors: Derek Clayton McGivern, Wallaceburg (CA); Paul Otto Kjeldsen, Mooretown (CA); Paul Thomas Arato, Toronto (CA); John Kenneth Bowes, Toronto (CA); Jason Paul Everaert, Wallaceburg (CA); Robert Wayne Coutryman, Port Lambton (CA)

(73) Assignee: Thruflow, Inc., Wallaceburg, Ontario (CA)

( * ) Notice: Subject to any disclaimer, the term of this patent is extended or adjusted under 35 U.S.C. 154(b) by 74 days.

(21) Appl. No.: 13/599,130

(22) Filed: Aug. 30, 2012

(65) Prior Publication Data

US 2013/0055511 A1 Mar. 7, 2013

Related U.S. Application Data

(60) Provisional application No. 61/530,048, filed on Sep. 1, 2011.

(51) Int. Cl.
*E01D 1/00* (2006.01)
*E04F 11/00* (2006.01)

(52) U.S. Cl.
CPC ..... *E04F 11/002* (2013.01); *E04F 2011/005* (2013.01); *E04F 2011/007* (2013.01)
USPC ..... 14/69.5

(58) Field of Classification Search
USPC ..... 14/69.5; 193/38
See application file for complete search history.

(56) References Cited

U.S. PATENT DOCUMENTS

| | | | | |
|---|---|---|---|---|
| 1,144,836 | A * | 6/1915 | Green | 14/69.5 |
| 2,779,958 | A * | 2/1957 | Hodges et al. | 14/69.5 |
| 3,074,239 | A | 1/1963 | Mustard | |
| 3,081,601 | A * | 3/1963 | Fentiman | 405/221 |
| 3,182,343 | A * | 5/1965 | Larson | 14/69.5 |
| 4,050,257 | A | 9/1977 | Parks et al. | |
| 4,468,901 | A | 9/1984 | Henderson et al. | |
| 4,630,709 | A | 12/1986 | Taylor | |

(Continued)

FOREIGN PATENT DOCUMENTS

| | | |
|---|---|---|
| AU | 577569 B | 9/1988 |
| GB | 2362630 A | 11/2001 |

OTHER PUBLICATIONS

Feb. 14, 2013 International Search Report and Written Opinion for PCT/IB2012/002558.

*Primary Examiner* — Abigail A Risic
(74) *Attorney, Agent, or Firm* — Howard & Howard Attorneys PLLC

(57) ABSTRACT

An adjustable, modular handicap-access-ramp system enables transport of wheelchairs and temporarily or permanently physically handicapped individuals and no-step access thereof into and out of a structure. The system comprises a plurality of core modules and at least one additional module adapted to be combined with each other and the core modules to configure a customized ramp. At least one combined locating and support pin is adapted to connect to each other those of the core and additional modules disposed adjacent to each other. At least one substantially infinitely adjustable column assembly allows movement of predetermined core and additional modules up or down and to a desired angle. At least one connector allows attachment to each other of adjacent core and additional modules that require a change in grade with respect to each other.

16 Claims, 4 Drawing Sheets

(56) References Cited

U.S. PATENT DOCUMENTS

| | | | | |
|---|---|---|---|---|
| 4,807,317 | A | 2/1989 | Quinn et al. | |
| 4,945,595 | A * | 8/1990 | Meriweather | 14/69.5 |
| 5,214,817 | A | 6/1993 | Allen | |
| 5,408,790 | A * | 4/1995 | Hoesten et al. | 52/263 |
| 5,740,575 | A * | 4/1998 | Gordon | 14/69.5 |
| 6,526,614 | B2 | 3/2003 | Anderson et al. | |
| 7,240,388 | B2 | 7/2007 | Warford | |
| 7,607,186 | B1 | 10/2009 | Mitchell | |
| 8,074,314 | B2 * | 12/2011 | Lucht | 14/69.5 |
| 8,370,982 | B2 * | 2/2013 | Peters | 14/69.5 |
| 8,387,191 | B2 * | 3/2013 | Honeycutt | 14/36 |
| 2004/0034950 | A1 | 2/2004 | Massaro | |
| 2004/0133998 | A1 | 7/2004 | Sloniker et al. | |
| 2005/0123380 | A1 | 6/2005 | Massaro | |
| 2006/0010621 | A1 | 1/2006 | Wentz et al. | |
| 2006/0059636 | A1 | 3/2006 | Suggate | |
| 2006/0156492 | A1 * | 7/2006 | Warford | 14/69.5 |
| 2008/0010757 | A1 * | 1/2008 | Hochstein et al. | 14/69.5 |
| 2009/0255066 | A1 | 10/2009 | Brock | |
| 2012/0036653 | A1 * | 2/2012 | Peters | 14/69.5 |

* cited by examiner

ADJUSTABLE, MODULAR HANDICAP-ACCESS-RAMP SYSTEM

REFERENCE TO RELATED APPLICATION

This application claims benefit of the filing date of U.S. Provisional Patent Application 61/530,048 filed on Sep. 1, 2011 and entitled "Adjustable, Modular Handicap-Access-Ramp System."

BACKGROUND OF INVENTION

1. Field of Invention

The invention relates, in general, to a ramp and, in particular, to a modular handicap-access-ramp system that is adjustable.

2. Description of Related Art

It is known to provide modular handicap-access-ramp systems each of which enables transport of wheelchairs and temporarily or permanently physically handicapped individuals and no-step access thereof into and out of an interior of a structure. The known system includes generally landings, platforms, ramps, and walkways that are designed to be interchangeable, interconnectable, and rearrangeable with respect to each other and permanent, semi-permanent, or temporary (lightweight and, thus, movable). In this way, the known system is designed to be disconnectable, hybrid, multi-configurable, portable, and pre-built. The known system is designed to be adjustable as well, providing access among different elevations and, thereby, facilitating use of the known system in various settings. The known system is designed also for its fabrication in sections at a site other than that where the system is assembled and readily assembled and disassembled.

More specifically: 1) U.S. Pat. No. 7,607,196 discloses a modular wheelchair ramp for its providing access for handicapped individuals into a building; 2) U.S. Patent Application Publication 2009/0255066 discloses a rearrangeable, interconnectable system for permanent, semi-permanent, or temporary ramps and platforms for access by handicapped persons to commercial buildings, semi-private constructions, homes, and other residences; 3) U.S. Pat. No. 7,240,388 discloses an adjustable, disconnectable, lightweight, portable wheelchair ramp; 4) U.S. Patent Application Publication 2006/0059636 discloses a modular, pre-built, temporary or permanent platform, walkway, or ramp; 5) U.S. Patent Application Publication 2006/0010621 discloses a hybrid, modular ramp for temporary or movable, no-step accessibility of wheelchairs to homes and other residences; 6) U.S. Patent Application Publication 2005/0123380 discloses a portable ramp system particularly intended to assist temporarily handicapped persons with transport thereof in and out of houses and buildings; 7) U.S. Patent Application Publication 2004/0133998 discloses an adjustable, multi-configuration ramp that facilitates use thereof in numerous settings for its providing access thereto among a variety of different elevations; 8) U.S. Patent Application Publication 2004/0034950 discloses a portable ramp system particularly intended to assist temporarily handicapped persons with transport thereof in and out of houses and buildings; 9) U.S. Pat. No. 6,526,614 discloses a portable, lightweight, modular ramp structure; 10) U.S. Pat. No. 5,214,817 discloses a modular ramp-and-landing-walkway assembly fabricated in sections at one site and assembled at a final site; and 11) U.S. Pat. No. 4,807,317 discloses a modular building-access ramp for physically handicapped individuals and capable of its ready assembly and disassembly.

However, the known systems suffer from disadvantages. More specifically, the known systems are institutional and, thus, aesthetically displeasing. Also, the known systems must be custom-ordered and cannot be packaged for retail sale. In particular, each unit of the known systems has to be custom-configured at a factory based upon a "site" evaluation, fabricated, and then delivered. Furthermore, modularity of the known systems is poor. For example, some of the known systems can include greater than one-hundred large parts and greater than one-thousand fasteners or parts thereof. In addition, configuration, design and engineering of the known systems are complex, and each of the known systems includes a great total number of parts. In this way, commercial availability of the known systems is limited, and cost in labor of assembly of the known systems is great. For instance, it can require greater than seven hours for any of the known systems to be assembled and ready to be used. Moreover, the known systems have substantially limited capacity and performance. It is difficult and time-consuming to deliver the known systems as well. For example, none of them generally can be delivered in a mini-van, or pick-up truck.

Thus, there is a need in the related art for an adjustable, modular handicap-access-ramp system that enables transport of wheelchairs and temporarily or permanently physically handicapped individuals and no-step access thereof into and out of an interior of a structure. More specifically, there is a need in the related art for such a system that is not institutional and, thus, aesthetically displeasing. There is a need in the related art for such a system also that does not need to be custom-ordered and can be packaged for retail sale. There is a need in the related art for such a system also modularity of which is not poor. There is a need in the related art for such a system also configuration, design, and engineering of which are not complex and that does not include a great total number of parts such that commercial availability of the system is not limited and cost in labor of assembly of the system is not great. There is a need in the related art for such a system also that does not have substantially limited capacity and performance. There is a need in the related art for such a system, also delivery of which is not difficult and time-consuming.

SUMMARY OF INVENTION

The invention overcomes the disadvantages in the related art in an adjustable, modular handicap-access-ramp system that enables transport of wheelchairs and temporarily or permanently physically handicapped individuals and no-step access thereof into and out of a structure. The system comprises a plurality of core modules and at least one additional module adapted to be combined with each other and the core modules to configure a customized ramp. At least one combined locating and support pin is adapted to connect to each other those of the core and additional modules disposed adjacent to each other. At least one substantially infinitely adjustable column assembly allows movement of predetermined core and additional modules up or down and to a desired angle. At least one connector allows attachment to each other of adjacent core and additional modules that require a change in grade with respect to each other.

One advantage of the adjustable, modular handicap-access-ramp system of the invention is that it is not institutional and, thus, aesthetically displeasing.

Another advantage of the adjustable, modular handicap-access-ramp system of the invention is that it does not need to be custom-ordered and can be packaged securely for retail sale and stocked at home-healthcare-retail locations easily and effectively near a point of sale for immediate pick-up of the system.

Another advantage of the adjustable, modular handicap-access-ramp system of the invention is that modularity of it is not poor. For example, modules of the system accommodate a majority of access applications required by the market and are completely interchangeable with each other such that modularity of the system is greater than that of the known systems.

Another advantage of the adjustable, modular handicap-access-ramp system of the invention is that configuration, design, and engineering thereof are simple.

Another advantage of the adjustable, modular handicap-access-ramp system of the invention is that it includes a small number of interoperable parts thereof.

Another advantage of the adjustable, modular handicap-access-ramp system of the invention is that commercial availability thereof is not limited.

Another advantage of the adjustable, modular handicap-access-ramp system of the invention is that cost in labor of assembly of the system, is not great. For example, the system allows a savings of about ninety percent in labor for assembly of the system over that of the known systems.

Another advantage of the adjustable, modular handicap-access-ramp system of the invention is that it does not have substantially limited capacity or performance. For example, the system is substantially infinitely adjustable in height and angle throughout its range of operation—say, level grade to forty-five inches—to accommodate even the smallest variation in specific application.

Another advantage of the adjustable, modular handicap-access-ramp system of the invention is that delivery of it is not difficult or time-consuming; rather, the system can be easily and quickly delivered, such as in a mini-van, van, or pick-up truck.

Another advantage of the adjustable, modular handicap-access-ramp system of the invention is that design thereof is attractive and colors of the system blend with most residential applications such that the system is more aesthetically pleasing than are the known systems. For example, taupe can accent columns, decking, and handrails of the system.

Another advantage of the adjustable, modular handicap-access-ramp system of the invention is that adjacent legs thereof are disposed substantially equidistantly from each other such that a profile of the system is consistent.

Another advantage of the adjustable, modular handicap-access-ramp system of the invention is that it takes "guesswork" out of planning a ramp because the system, as in an embodiment thereof, has only six completely assembled modules (that must be configured with each other) for easy conceptualization of the system by retailers and homeowners alike.

Another advantage of the adjustable, modular handicap-access-ramp system of the invention is that, since parts thereof fit with each other only one way (which is simple to determine), the system can be easily and entirely intuitively assembled/installed on a job site fast and consistently with merely a level and a couple of wrenches and ready to be used in less than an hour (no interpretation required).

Another advantage of the adjustable, modular handicap-access-ramp system of the invention is that no maintenance for walking surfaces and other parts of the system is required for keeping it aesthetically pleasing. For example, a walking surface of a ramp of the system is constructed of a maintenance-free composite-polymer panel and is supported by a maintenance-free, light, strong, durable substructure.

Another advantage of the adjustable, modular handicap-access-ramp system of the invention is that it is safer than the known systems. In this regard, an embodiment of the system: includes three-hundred-and-sixty-degree, grated, firm, persistent, non-slip decking, walkway, or other surfacing (static coefficient of slip of 0.78) of the system to help prevent slip-and-fall injuries; includes a built-in photo-luminescent guide strip that is disposed at a side of a walking surface (e.g., integrated with an aluminum sidewall or into a main side beam) of the system to indicate implicitly outer extents thereof and guide users of the system therealong in low-light areas or nighttime conditions by providing the users a distinct line for "foot falls"; pays special attention to texture and "feel" of a handrail, handholds, and touchable surfaces of the system to ensure surety for users thereof and consistency and safety throughout a range of adjustment of the modules; effectively drains water such that there is never any standing water on the system and resists any standing or build-up of snow, ice, sand, and soil, thus reducing trip or slip hazards significantly over closed or mostly closed walking surfaces; and includes integrated positive stops of about four-and-a-half inches bounding a periphery of a surface of a ramp of the system, thereby protecting against undesirable over-reaching of the ramp surface by assistive devices or foot-steps.

Another advantage of the adjustable, modular handicap-access-ramp system of the invention is that it pays special attention to texture and "feel" of a handrail, handholds, and touchable surfaces of the system to ensure comfort for users thereof and a walking surface of the system is made from a polymer and supported by a substructure such that the walking surface is very quiet and comfortable for the users.

Another advantage of the adjustable, modular handicap-access-ramp system of the invention is that it is light, strong, and durable. For example, the system does not disturb surroundings thereof with excessive clings and clangs of the system because of its structural integrity.

Another advantage of the adjustable, modular handicap-access-ramp system of the invention is that it includes no spaces or openings in which insects, such as hornets and wasps, can take up residence and, hence, is free from insect-incursion and resistant to impregnation and destruction of the system by insects.

Other objects, features, and advantages of the adjustable, modular handicap-access-ramp system of the invention are readily appreciated as it becomes better understood while reading the subsequent detailed description of embodiments of the system taken in conjunction with the accompanying drawing thereof.

BRIEF DESCRIPTION OF EACH FIGURE OF DRAWING

Figure 1:
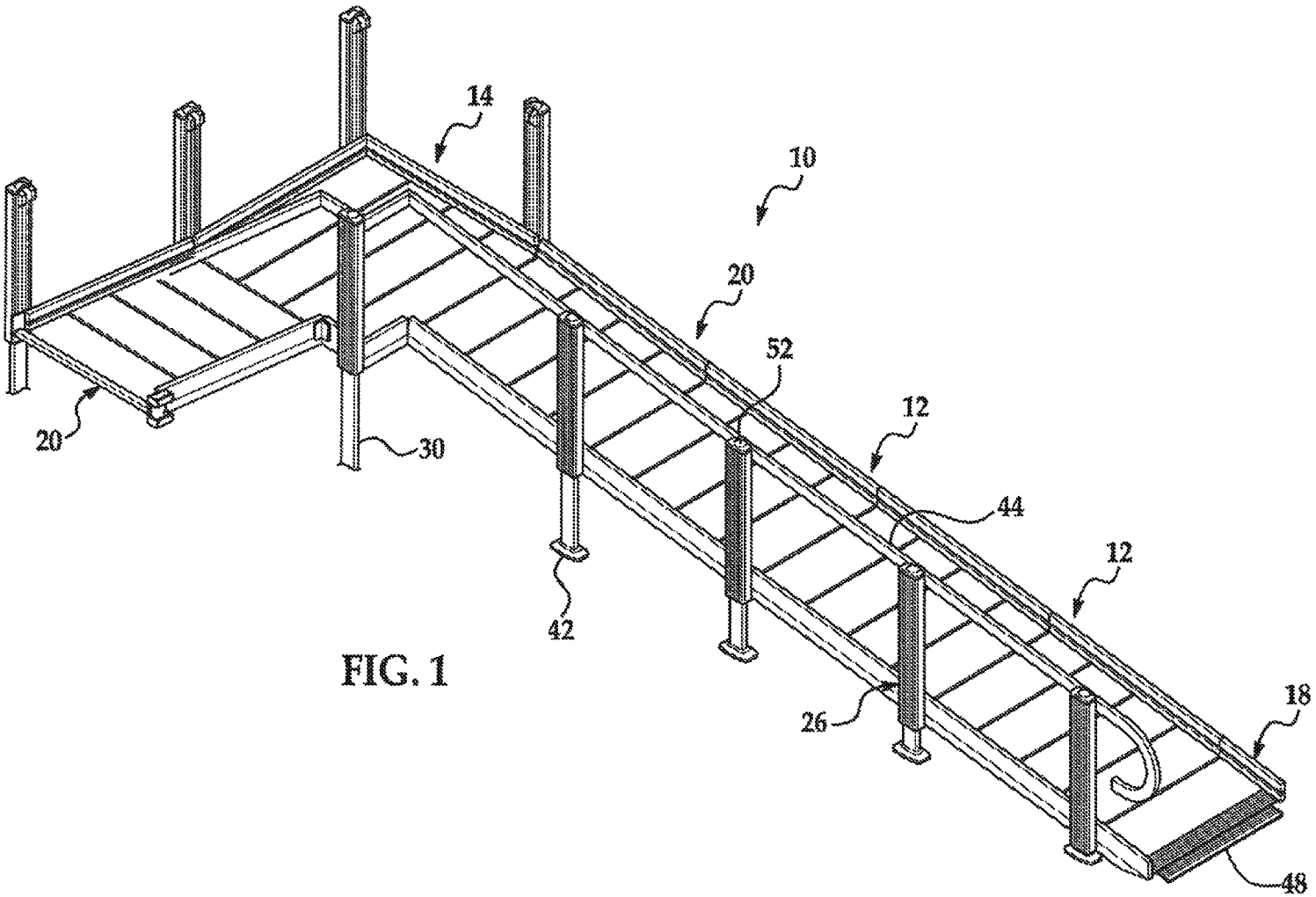
FIG. 1 is a perspective view of an embodiment of the adjustable, modular Handicap-access-ramp system of the invention shown assembled.
Figure 4:
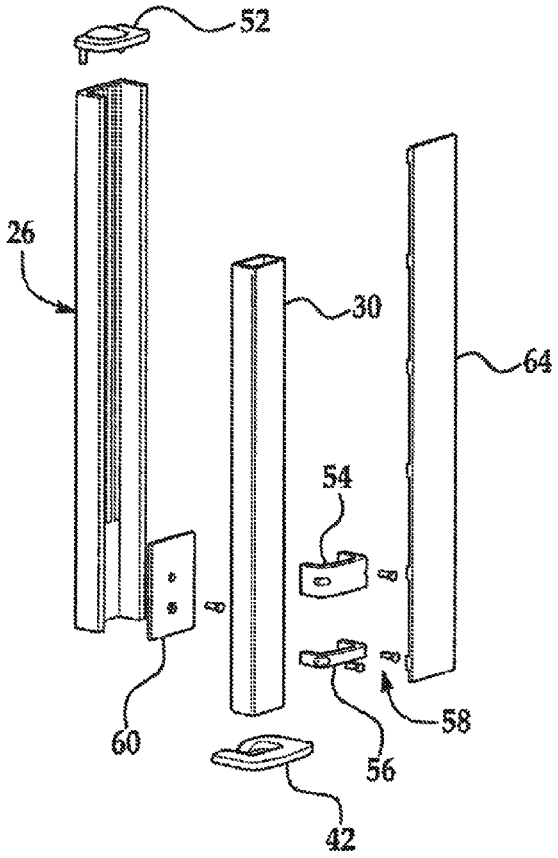
Figure 5:
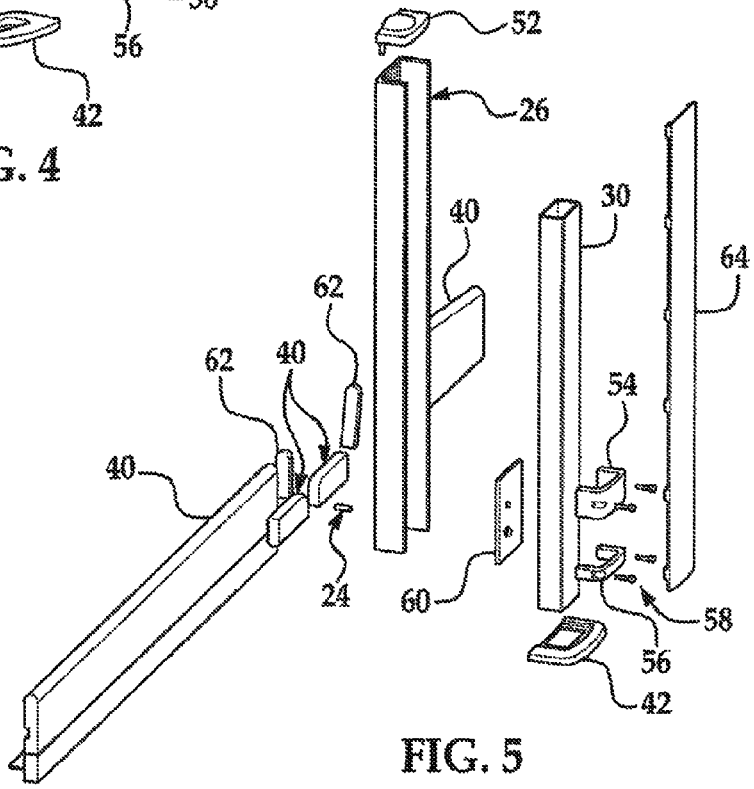

FIG. 4 is an exploded environmental assembly view showing the substantially infinitely adjustable (in height) column assembly (upper-leg assembly) of the embodiment of the adjustable, modular handicap-access-ramp system of the invention shown in FIG. 1; and FIG. 5 is an exploded environmental assembly view showing the articulating connector of the embodiment of the adjustable, modular handicap-access-ramp system of the invention shown in FIG. 1.

DETAILED DESCRIPTION OF EMBODIMENTS(S) OF INVENTION

Referring now to the figures, where like numerals are used to designate like structure, an embodiment of an adjustable, modular handicap-access-ramp system of the invention is generally indicated at 10 in FIG. 1. (The system 10 is referred to hereinafter interchangeably as "the ramp.") The system 10 enables transport of wheelchairs and their respective temporarily or permanently physically handicapped individuals and no-step access thereof into and out of an interior of a structure [including an exterior structure (e.g., a gazebo, viewing platform, dock, etc.)]. To this end, the system 10 includes generally landings, platforms, ramps, and walkways that are interchangeable, interconnectable, and rearrangeable with respect to each other and temporary (lightweight and, thus, movable). The system 10 also is adjustable, disconnectable, hybrid, multi-configurable, portable, and pre-built. It should be appreciated by those having ordinary skill in the related art that tire structure can be any commercial building, semi-private construction (such as a hospital or school), home or other residence, or other suitable building. It should be so appreciated also that the adjustability of the system 10 provides access among different elevations and, thereby, facilitates use of the system 10 in various settings. It should be so appreciated also that the system 10 can be fabricated in sections at one site and assembled at a final site and is capable of ready assembly and disassembly of the system 10. Although measurements below are given generally in "English" units, it should be so appreciated also that such measurements include "metric" counterparts of such units.

The system 10, in general, includes a plurality of core modules (sections or units), generally indicated at 12, 14, 18, 20 adapted to be combined with each other to configure the ramp 10 to custom. At least one combined locating and support pin, generally indicated at 24, is adapted to connect to each other those of the modules 12, 14, 18, 20 disposed adjacent to each other. At least one substantially infinitely adjustable column or upper-leg assembly, generally indicated at 26, allows movement of predetermined modules 12, 14, 18, 20 up or down and to a desired angle. At least one connector, generally indicated at 28, allows attachment to each other of adjacent modules 12, 14, 18, 20 that require a change in grade with respect to each other.

With respect to an embodiment of the system 10 adapted to be employed in a "residential" setting and referring specifically to FIG. 1, the system 10 includes, by way of example only, four core modules 12, 14, 18, 20—which accommodate a majority of "access" applications required by the market and are made to be completely interchangeable with each other—and two additional modules 12, 20—which are employed to accommodate variation of any additional application that may be required for a particular specification. Each of the core modules 12, 14, 18, 20 includes a plurality of legs (or lower legs or column extenders) 30. Adjacent legs 30 of the ramp 10 are disposed substantially equidistantly (for example, substantially forty-eight inches) from each other such that a profile of the ramp 10 is consistent. The infinitely adjustable column assembly 26 allows movement of the predetermined modules 12, 14, 18, 20 up or down and to a desired angle about the combined locating and support pin 24 within safe operating parameters, say, within a substantially forty-degree range. In an "assembled" state of the system 10, the system 10 is substantially thirty-six inches wide. Each of the modules 12, 14, 18, 20, combined locating and support pin 24, infinitely adjustable column assembly 26, and connector 28 is described in detail below.

Figure 2:
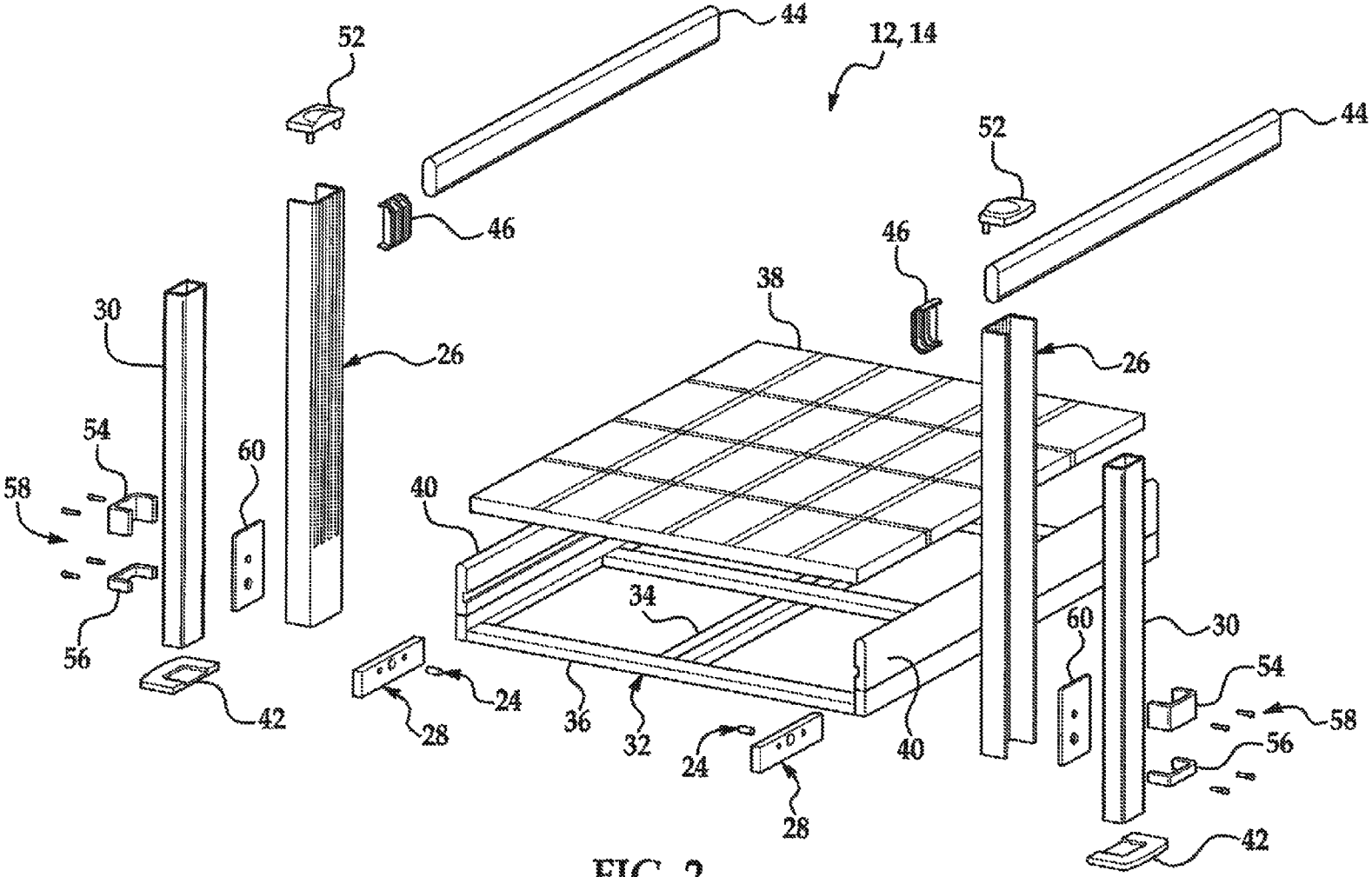
FIG. 2 is an exploded assembly view of a "straight run" ramp section of the core modules of the embodiment of the adjustable, modular handicap-access-ramp system of the invention shown in FIG. 1.

In particular and as shown in FIG. 1, the system 10 includes a "base" core module (the base module) 12 that is substantially 36"×48", includes a walkway and an opposed pair of legs 30, is a "straight run" section used in a continuous run of the ramp 10, and is disposed substantially non-parallel with ground (not shown). As best shown in FIG. 2, the base-module 12 includes a substructure, generally indicated at 32, that is substantially 4'×3' and has at least one three-channel center beam (tri-chamber support) 34 and at least one two-channel transverse beam (twin-chamber support) 36. In an embodiment of the system 10, the substructure 32 has a pair of three-channel center beams 34 and three two-channel transverse beams 36. The base module 12 includes also at least one solid panel 38 that is substantially 3'×1' with a plurality of lugs (not shown). In an embodiment of the system 10, the base module 12 includes four "ThruFlow®" brand panels 38. Both ends of each of an opposed pair of "straight run" main side beams 40 of the substructure 32 are cut substantially flat such that the substructure 32 can mate with at least another "straight run" section of the ramp 10. Either or both of the ends of the base module 12 can be tapered. An illuminated guide (not shown) is integrated into the main side beam 40 to locate outer extents of a walking surface of the base module 12 and guide users of the system 10 along the ramp 10. The illuminated guide is most beneficial in low-lighted areas and provides a distinct line for "foot falls."

The legs 30 are attached to the base module 12 in a "shipping" or "horizontal to walking surface" position. However, once the base module 12 is connected to at least another section of the ramp 10, the legs 30 are transitioned to an "upright" position and fastened to the base module 12. The legs 30 are adapted to be adjusted to a desired height and angle and installed with corresponding feet 42. An opposed pair of handrails 44 are attached with corresponding "straight run" sockets 46 after the sections of the ramp 10 are fully assembled to each other. In an embodiment of the system 10, each handrail 44 is substantially forty-seven inches long and defines a substantially oval transverse cross-section of the handrail 44. The base module 12 includes also an opposed pair of "straight run" connectors 28 (as part of the respective main side beams 40) with corresponding combined locating and support pins 24, an opposed pair of upper-leg (or column) caps 52, an opposed pair of three-quarter-inch leg (or extender) clamps 54, an opposed pair of three-quarter-inch leg (or extender) clamps 56, an opposed pair of a set of clamp fasteners, generally indicated at 58, and an opposed pair of column-reinforcing plates 60.

As shown in FIG. 1, a "platform" core module (the platform module) 14 is substantially 48"×48", facilitates ninety-degree turns and rests of a wheelchair on the platform module 14, and is substantially parallel with the ground. The platform module 14 includes a walkway, four legs 30, and a substructure 32 that is substantially 4'×4'. The platform module 14 is typically set to a desired height of a stoop to allow for easy entry on and exit off the platform module 14. The legs 30 are unattached and installed to the corresponding main side beam 40. Once the platform module 14 is installed, the height of the platform module 14 is set to an appropriate level, the feet 42 are installed to the corresponding legs 30, and a "straight run" ramp section is installed to the platform module 14 via a plurality of the connectors 28 that are pre-installed (already attached) and described in greater detail below. Once assembly of the platform module 14 is complete, the handrails 44 are attached using the corresponding sockets 46. More specifically, the platform module 14 includes two complete welded handrail assemblies 44 and corresponding sockets 46 each of which connects the respective handrail assembly 44 to the corresponding handrail 44 of a base module 12 and/or module 20 (which is described in detail below).

As shown in FIG. 1, a base module 12 can be a "no leg" base module 12 and substantially 36"×48", a "straight run" section of the ramp 10, and disposed substantially non-parallel with the ground. The "no leg" base module 12 includes a walkway, an articulating end, and a substructure 32 that is substantially 4'×3'. The "no leg" base module 12 also is adapted to be assembled to another base module 12 and used when approaching or departing from the platform module 14. The end of the corresponding main side beam 40 that is mated to the platform module 14 awaiting a plurality of connectors 28 is angle-cut to accommodate for articulation. The base module 12 defines angle-cuts on both ends. In an embodiment of the system 10, there are a pair of connectors 28 and the corresponding combined locating and support pins 24. Since the connected platform module 14 supports the "no leg" base module 12, no legs 30 are required. A plurality of handrails 44 are installed with the corresponding sockets 46 after foil assembly of the "no leg" base, module 12. In an embodiment of the system 10, there are a pair of handrails 44. Either or both of the ends of the "no leg" base module 12 can be tapered.

Figure 3:
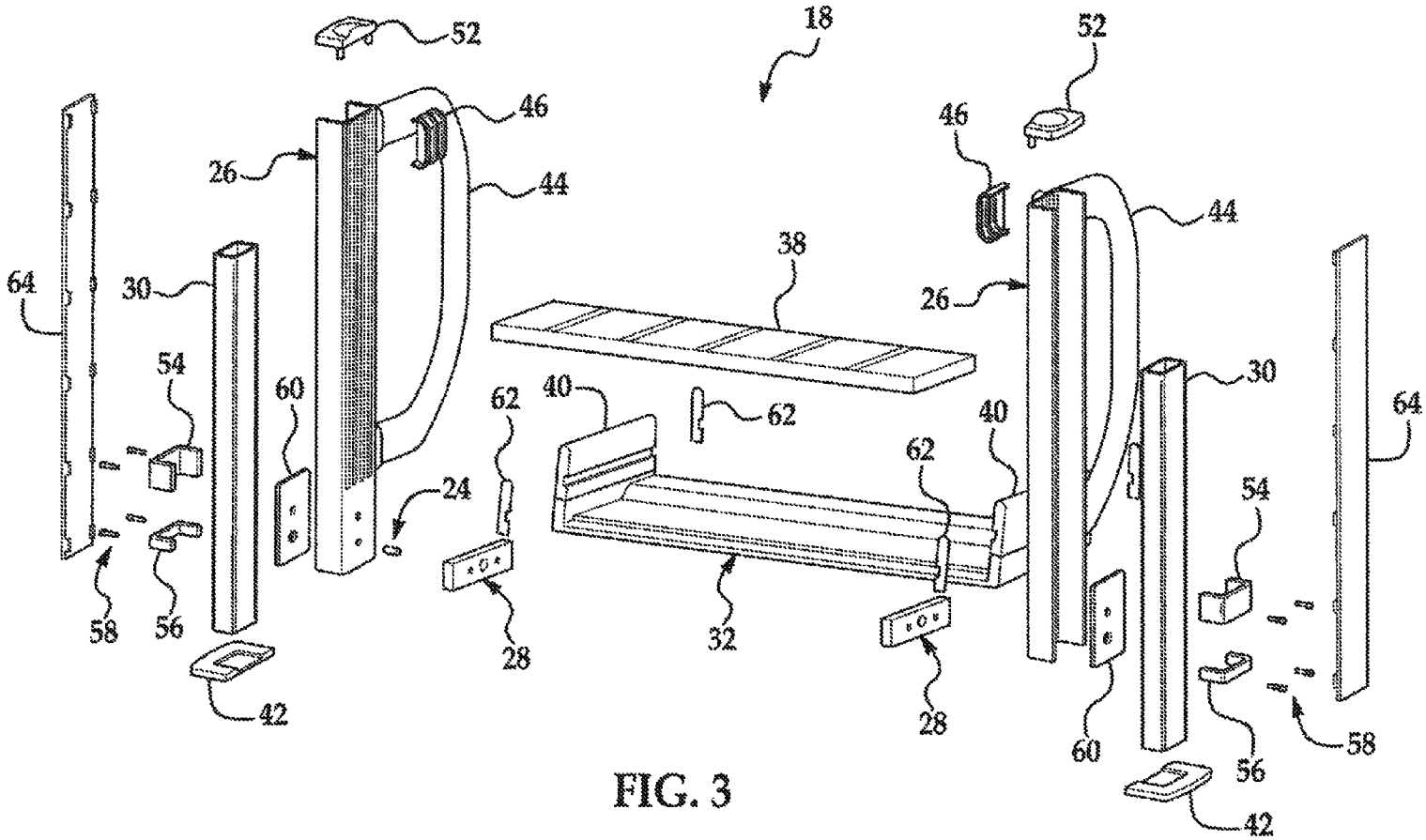
FIG. 3 is an exploded assembly view of an "entry/exit" section of the core modules of the embodiment of the adjustable, modular handicap-access-ramp system of the invention shown in FIG. 1.

As shown in FIG. 1, an "entry/exit" core module (the entry/exit module) 18 is substantially 36"×18" and allows entry/exit with respect to a walkway of the base or platform module 12, 14. As best shown in FIG. 3, the entry/exit module 18 includes a substructure 32, and the corresponding main side beam 40 is taper-cut lengthwise to lower a walking surface of the entry/exit module 18 to ground level (a rib of the main side beam 40 is cut away). A bent aluminum plate 48 (a separate feature, but not a separate part) that is substantially six inches wide is welded into a frame of the entry/exit module 18 and adapted to get the entry/exit module 18 closer to the ground with minimal to no threshold to overcome. An opposed pair of bent loops are first of the handrails 44 to be installed and attached with at least one center carriage bolt (not shown). Each of the bent handrails 44 is welded to the corresponding upper leg 26 with a socket 46 to accept the respective handrail 44 of a base module 12 or module 20. The sockets 46 are pre-welded onto the corresponding loops for easy installation. The entry/exit module 18 includes also a panel 38, a plurality of connectors 28, a pair of plugs 62, and an opposed pair of column covers 64. In an embodiment of the system 10, the entry/exit module 18 includes a pair of connectors 28.

As shown in FIG. 1, the module 20 is substantially rectangular, five feet long, and non-parallel with the ground. The module 20 is to be used when a run of the ramp 10 is longer than substantially twenty-eight feet and includes a substructure 32 that is substantially 5'×3'. Both ends of the corresponding main side beam 40 are angle-cut to mate with the "no leg" base module 12 or any angular-cut section to allow for articulation. The legs 30 are packaged on the platform and require installation to the module 20 on site. Once the module 20 is installed to the main side beam 40, height of the module 20 is adjusted along with the feet 42 being installed to the corresponding legs 30. A plurality of handrails 44 are installed with the corresponding sockets 46 after complete assembly of the sections of the ramp 10. More specifically, the module 20 includes two complete welded handrail assemblies 44 and corresponding sockets 46 each of which connects the respective handrail assembly 44 to the corresponding handrail 44 of the base module 12. Another four adjustable sockets 46 are substantially offset to allow articulation while still fastening with at least one main carriage bolt (not shown). The module 20 includes also a plurality of panels 38—specifically, five panels each of which is substantially 3'×1'—and a plurality of connectors 28 and corresponding combined locating and support pins 24—specifically, four connectors 28.

As shown in FIG. 1, the module 20 can serve as a "departure" or "exit" module 20 and be substantially rectangular, non-parallel with the ground, and aluminum-extruded. In this way, the module 20 is used to exit directly from the platform module 14 onto a desired stoop with minimal to no threshold to overcome, especially when tight space requirements need to be met. To this end, the module 20 includes a "departure" plate (not shown) that is substantially six inches wide.

As shown in FIG. 4, a pair of extender clamps 54, 56 wrap around three sides of the infinitely adjustable column assembly 26 and lower leg 30. Fastening of the clamps 54, 56 against the lower leg 30 secures adjustment of height of a section of the ramp 10. The lower leg 30 is clamped between the clamps 54, 56 to the column-reinforcing plate 60 that is attached to the upper-leg assembly 26. The upper-leg assembly 26 is attached to the corresponding main side beam 40 (FIG. 5) between the column-reinforcing plate 60 through which the combined locating and support pin 24 (FIG. 5) and fasteners 58 are placed. In an embodiment of the system 10, the fasteners, are hex-button head-cap screws 58. Movement about the combined locating and support pin 24 provides for adjustment of angle (the infinitely adjustable column assembly 26 to the main side beam 40), facilitating a need for the infinitely adjustable column assembly 26 to be substantially perpendicular to grade. In an embodiment of the system 10, the combined locating and support pin 24 is one-half-inch steel.

As stated above, the components work with each other to create the infinitely adjustable column assembly 26, which allows movement of the platform module 14 or any other section of the ramp 10 up or down, and to the angle desired. The column-reinforcing plate 60 is steel and reinforces structure of the infinitely adjustable column assembly 26 for clamping of the lower leg 30 and attachment of sections of the ramp 10 with each other. The extender clamps 54, 56 are fastened to the column-reinforcing plate 60 with four bolts (not shown). The column cap 52 is a finishing piece that encloses the infinitely adjustable column assembly 26 and blends the infinitely adjustable column assembly 26 with the handrail 44. The upper-leg assembly 26 is aluminum-extruded and defines an open side of the upper-leg assembly 26 that is designed to fit machined parts and fasteners that form the infinitely adjustable column assembly 26. The column cover 64 attaches to the upper-leg assembly 26 and covers the open side to give an outside of the infinitely adjustable column assembly 26 an aesthetically pleasing appearance after installation and/or adjustment. The extender clamps 54, 56 are aluminum and hold the lower leg 30 in place when the lower leg 30 is tightened down. The column extender 30 is aluminum-extruded and allows the ramp 10 to be lowered or raised to a desired height. The foot 42 rests inside the lower leg 30, thus providing a bigger footprint for stability and support of the ramp 10. In an embodiment of the system 10, the foot 42 is made of urethane, and the infinitely adjustable column assembly 26 defines a plurality of holes.

As shown in FIG. 5, the connector 28 includes a pair of substantially identical pieces that are fitted with each other and incorporate the combined locating and support pin 24 to form a hinge. The two pieces 28 articulate about the combined locating and support pin 24, thus providing the adjustability. The connector 28 is made so that there is a positive stop to allow for a maximum of the angle or adjustability of only, say, substantially 1:3 slope from level (<+/−20° or 36.4% grade). Each side of the connector 28 is inserted into a lower hollow of the joining main side beam 40 on the joining modules. Each of the modules 12, 14, 18, 20 is machined such that the module 12, 14, 18, 20 orients on the combined locating and support pin 24 on a connector 28. The infinitely adjustable column assembly 26 then fits over and is located by and retained on the combined locating and support pin 24. The fasteners 58 secure (the column-reinforcing plate 60 through connectors 28) the entire infinitely adjustable column assembly 26 to frames, thereby creating a structural connection. The connector 28 includes also the pair of plugs 62.

With respect to the connectors, there are three types of connectors—1) "straight" connectors that are adapted to be employed with the base module 12 to facilitate "runs"; 2) "articulating" connectors that are adapted to be employed with platforms such as the platform module 14 and entry/exit module 18; and 3) "ninety degree" connectors that supplement the articulating connectors on "ninety-degree turn" platforms. All "running" sections that are made of only the base module 12 and module 20 are connected with "straight" connectors whereas all other connections are made via "articulating" connectors.

With respect to the handrails 44, there are four differing handrail-connector systems made-up of several parts. Each of the base module 12 and module 20 include the same pair of identical handrails 44. The platform module 14 includes two complete welded handrail assemblies 44 and corresponding sockets 46 each of which connects the respective handrail assembly 44 to the corresponding handrail 44 of the base module 12 and module 20. Each of the sockets 40 is disposed substantially flush with the corresponding main side beam 40.

With respect to plugs 62 and panels 38, all of the modules 12, 14, 18, 20 include plugs 62 and panels 38 in differing quantities.

Those having ordinary skill in the related art should appreciate that the system 10 can include at least one additional module. For example, the system 10 can include a "straight-run rest" module (not shown) that is substantially similar to, say, the module 20 in at least many respects, but substantially parallel with the ground.

In operation of the system 10, the manner in which each module 12, 14, 18, 20 is connected to an adjacent module 12, 14, 18, 20 integrates support and adjustment of height of the ramp 10. One end of the base module 12 can be connected with the connector 28, which makes assembly of continuous runs of straight ramp easier to assemble and manage. Adjacent modules 12, 14, 18, 20 are connected with each other via a combined locating and support pin 24 about which infinite adjustment of angle of one module 12, 14, 18, 20 relative to another module 12, 14, 18, 20 is possible. Applications of the system 10 may differ with respect to each other, whether in connection with height requirement and/or "entry"/"exit" interface with application grade. The combination of the modules 12, 14, 18, 20, combined locating and support pin 24, infinitely adjustable column assembly 26, and connector 28 ensures easy, consistent assembly and full height and angle adjustment of the ramp 10 within safe operating parameters.

Those having ordinary skill in the related art should appreciate that the system 10 can be employed in a larger "commercial" setting as well. To that end, an embodiment of the system 10 can include sections 12, 14, 18, 20 each of which is substantially 48" wide by 48" long and platforms 14 each of which is substantially 60" wide by 60" long. An alternative embodiment of the system 10 can include sections 12, 14, 18, 20 each of which is substantially 60" wide by 48" long and platforms 14 each of which is substantially 60" wide by 60" long or 72" wide by 72" long.

It should be appreciated by those having ordinary skill in the related art that: the system 10 can include any suitable number of core modules 12, 14, 18, 20 and additional modules; the modules 12, 14, 18, 20 can be connected/attached/assembled to each other in any suitable manner and made of any suitable material; each of the modules 12, 14, 18, 20 can be moved any suitable distance and to any suitable angle in any suitable manner, include any suitable number of legs 30, and have any suitable purpose; each of the modules 12, 14, 18, 20 can be also disposed at any suitable angle with respect to the ground and have any suitable shape, size, structure and structural relationship with any of the other modules 12, 14, 18, 20; the system 10 can include any suitable type and number of components (other than the modules 12, 14, 18, 20) and sub-components; the components and sub-components can be connected/attached/assembled to each other in any suitable manner and made of any suitable material; each of the components and sub-components can have any suitable purpose, shape, size, structure and structural relationship with any of the other components and/or sub-components; adjacent legs 30 can be disposed any suitable distance from each other; applications of the system 10 can differ slightly with respect to each other in height requirement and/or "entry"/"exit" interface with grade; any suitable number of modules 12, 14, 18, 20 can include legs 30.

The system 10 is not institutional and, thus, aesthetically displeasing. Also, the system 10 does not need to be custom-ordered and can be packaged securely for retail sale and stocked at home-healthcare-retail locations easily and effectively near a point of sale for immediate pick-up of the system 10. Furthermore, modularity of the system 10 is not poor. For example, modules 12, 14, 18, 20 of the system 10 accommodate a majority of access applications required by the market and are completely interchangeable with each other such that modularity of the system 10 is greater than that of the known systems. In addition, configuration, design, and engineering of the system 10 are simple. Moreover, the system 10 includes a small number of interoperable parts of the system 10. Plus, commercial availability of the system 10 is not limited. Cost in labor of assembly of the system 10 is not great as well. For example, the system 10 allows a savings of about ninety percent in labor for assembly of the system 10 over that of the known systems.

The system 10 does not have substantially limited capacity or performance. For example, the system 10 is infinitely adjustable in height and angle throughout its range of operation—say, level grade to forty-five inches—to accommodate even the smallest variation in specific application. Also, delivery of the system 10 is not difficult or time-consuming. Rather, the system 10 can be easily and quickly delivered, such as in a mini-van, van, or pick-up truck. Furthermore, design of the system 10 is attractive, and colors of the system 10 blend with most residential applications such that the system 10 is more aesthetically pleasing than are the known systems. For example, taupe can accent the infinitely adjustable columns 26, decking, and handrails 44 of the system 10. In addition, the adjacent legs 30 of the system 10 are disposed substantially equidistantly from each other such that a profile of the system 10 is consistent. Moreover, the system 10 takes "guesswork" out of planning the ramp 10 because an embodiment of the system 10 has only the four completely assembled modules 12, 14, 18, 20 (that must be configured with each other) for easy conceptualization of the system 10 by retailers and homeowners alike. Plus, since parts of the system 10 fit with each other only one way (which is simple to determine), the system 10 can be easily and entirely intuitively assembled/installed on a job site fast and consistently with merely a level and a couple of wrenches and ready to be used in less than an hour (no interpretation required). No maintenance for walking surfaces and other parts of the system 10 is required for keeping the system 10 aesthetically pleasing as well. For example, a walking surface of a ramp of the system 10 is constructed of a maintenance-free composite-polymer panel and is supported by the maintenance-free, light, strong, durable substructure 32.

The system 10 is safer than the known systems. In this regard, an embodiment of the system 10 includes three-hundred-and-sixty-degree, grated, firm, persistent, non-slip decking, walkway, or other surfacing (static coefficient of slip of 0.78) of the system 10 to help prevent slip-and-fall injuries. Also, the system 10 includes a built-in photo-luminescent guide strip that is disposed at a side of a walking surface (e.g., integrated with an aluminum sidewall or into the main side beams 40) of the system 10 to indicate implicitly outer extents of the system 10 and guide users of the system 10 along the system 10 in low-light areas or nighttime conditions by providing the users a distinct line for "foot falls." Furthermore, the system 10 pays special attention to texture and "feel" of the handrails 44, handholds, and touchable surfaces of the system 10 to ensure surety for users of the system 10 and consistency and safety throughout a range of adjustment of the modules 12, 14, 18, 20. In addition, the system 10 effectively drains water such that there is never any standing water on the system 10 and resists any standing or build-up of snow, ice, sand, and soil, thus reducing trip or slip hazards significantly over closed or mostly closed walking surfaces. Moreover, the system 10 includes integrated positive stops of about four-and-a-half inches bounding a periphery of a surface of a ramp of the system 10, thereby protecting against undesirable over-reaching of the ramp surface by assistive devices or "foot steps."

The system 10 pays special attention to texture and "feel" of the handrails 44, handholds, and touchable surfaces of the system 10 to ensure comfort for users of the system 10, and a walking surface of the system 10 is made from a polymer and supported by the substructure 32 such that the walking surface is very quiet and comfortable for the users. Also, the system 10 is light, strong, and durable. For example, the system 10 does not disturb surroundings of the system 10 with excessive clings and clangs of the system 10 because of structural integrity of the system 10. Furthermore, the system 10 includes no spaces or openings in which insects, such as hornets and wasps, can take up residence and, hence, is free from insect-incursion and resistant to impregnation and destruction of the system 10 by insects.

The system 10 has been described above in an illustrative manner. It is to be understood that the terminology that has been used above is intended to be in the nature of words of description rather than of limitation. Many modifications and variations of the system 10 are possible in light of the above teachings. Therefore, within the scope of the appended claims, the system 10 may be practiced other than as specifically described above.

What is claimed is:

1. An adjustable, modular handicap-access-ramp system that enables transport of wheelchairs and temporarily or permanently physically handicapped individuals and no-step access thereof into and out of a structure, said system comprising:

a plurality of core modules adapted to be combined with each other to configure a customized ramp, said core modules including a walkway and a substructure having at least one main side beam;

at least one combined locating and support pin adapted to connect to each other those of said core modules disposed adjacent to each other;

at least one substantially infinitely adjustable column assembly having a leg and allowing movement of predetermined ones of said core modules either of up and down and to a desired angle;

at least one connector allowing attachment to each other of said adjacent ones of said core modules that require a change in grade with respect to each other; and wherein at least one extender clamp wraps around at least one side of said infinitely adjustable column assembly and leg, fastening of said extender clamp against said leg secures adjustment of height of said core module, said leg is clamped to a column-reinforcing plate that is attached to said infinitely adjustable column assembly, said infinitely adjustable column assembly is attached to said main side beam between said column-reinforcing plate through which said combined locating and support pin and at least one fastener are placed such that movement about said combined locating and support pin provides for adjustment of angle of said infinitely adjustable column assembly to said main side beam, facilitating a need for said infinitely adjustable column assembly to be substantially perpendicular to grade.

2. An adjustable, modular handicap-access-ramp system as set forth in claim 1, wherein said infinitely adjustable column assembly allows movement of said predetermined core modules up or down and to a desired angle about said combined locating and support pin within either of a twenty-degree range and 36.4% grade.

3. An adjustable, modular handicap-access-ramp system as set forth in claim 1, wherein said core modules include a "base" module, "platform" module, "entry/exit" module, and module.

4. An adjustable, modular handicap-access-ramp system as set forth in claim 1, wherein at least one of said walkway and substructure has at least one three-channel center beam and at least one two-channel transverse beam.

5. An adjustable, modular handicap-access-ramp system as set forth in claim 4, wherein said substructure has a pair of three-channel center beams and three two-channel transverse beams.

6. An adjustable, modular handicap-access-ramp system as set forth in claim 4, wherein said substructure has a bent aluminum plate adapted to get said core module closer to ground.

7. An adjustable, modular handicap-access-ramp system as set forth in claim 1, wherein at least one of said core modules includes at least one solid panel.

8. An adjustable, modular handicap-access-ramp system as set forth in claim 4, wherein both ends of said main side beams are cut substantially flat such that said substructure can mate with at least another of said core modules of said system.

9. An adjustable, modular handicap-access-ramp system as set forth in claim 8, wherein said connector and combined locating and support pin are part of said main side beam.

10. An adjustable, modular handicap-access-ramp system as set forth in claim 8, wherein said both ends of said main side beam are angle-cut to mate with said core module to allow for articulation of said core module.

11. An adjustable, modular handicap-access-ramp system as set forth in claim 1, wherein at least one of said core modules includes at least one handrail.

12. An adjustable, modular handicap-access-ramp system as set forth in claim 1, wherein said at least one core module includes any combination of a walkway, at least one lug, at least one foot, at least one socket, at least one upper-leg cap, at least one leg clamp, at least one leg clamp, at least one clamp fastener, at least one column-reinforcing plate, at least one plug, at least one column cover, at least one center carriage bolt, at least one main carriage bolt, and a departure plate.

13. An adjustable, modular handicap-access-ramp system as set forth in claim 1, wherein said infinitely adjustable column assembly allows movement of said core module up and down and to the angle desired, said column-reinforcing plate reinforces said infinitely adjustable column assembly for clamping of said leg and attachment of said core module and at least another of said core modules with each other, and said extender clamps are fastened to said column-reinforcing plate.

14. An adjustable, modular handicap-access-ramp system as set forth in claim 1, wherein said infinitely adjustable column assembly defines an open side of said infinitely adjustable column assembly that is designed to fit machined parts and fasteners that form said infinitely adjustable column assembly.

15. An adjustable, modular handicap-access-ramp system as set forth in claim 1, wherein the adjustability is substantially 1:3 slope from level.

16. An adjustable, modular handicap-access-ramp system as set forth in claim 1, wherein at least one of said core modules orients on said combined locating and support pin on said connector, said infinitely adjustable column assembly fits over and is located by and retained on said combined locating and support pin, and at least one fastener secures said infinitely adjustable column assembly to said core module, thereby creating a structural connection between said infinitely adjustable column assembly and core module.

* * * * *